US005796019A

United States Patent [19]

Lupton et al.

[11] Patent Number: 5,796,019

[45] Date of Patent: Aug. 18, 1998

[54] METHOD OF MANUFACTURING AN ELECTRICALLY CONDUCTIVE CERMET

[75] Inventors: David Francis Lupton, Gelnhausen; Jörg Schielke, Bruchköbel; Hans-Joachim Graf, Mannheim; Arno Reckziegel, Frankfurt, all of Germany

[73] Assignees: W.C. Heraeus GmbH; Friatec AG, both of Germany

[21] Appl. No.: 583,516

[22] Filed: Jan. 5, 1996

[30] Foreign Application Priority Data

Jan. 25, 1995 [DE] Germany ..... 195 02 129.0

[51] Int. Cl.[6] ..... C22C 29/12

[52] U.S. Cl. ..... 75/235; 252/514; 419/19; 419/20

[58] Field of Search ..... 252/514; 75/235, 75/247; 419/20, 21, 38, 19

[56] References Cited

U.S. PATENT DOCUMENTS

| | | | |
|---|---|---|---|
| 3,166,417 | 1/1965 | Gainsbury . | |
| 3,623,849 | 11/1971 | Benjamin . | |
| 3,901,717 | 8/1975 | Revaz | 106/42 |
| 4,183,746 | 1/1980 | Pearce et al. | 75/234 |
| 4,234,338 | 11/1980 | Morgan et al. | 75/235 |

FOREIGN PATENT DOCUMENTS

| | | |
|---|---|---|
| 26 58 647 A1 | 7/1977 | Germany . |
| 40 29 066 C2 | 3/1992 | Germany . |
| 1046330 | 2/1964 | United Kingdom . |
| WO 89/01706 | 2/1989 | WIPO . |
| WO 93/17969 | 9/1993 | WIPO . |

*Primary Examiner*—Ngoclan Mai

*Attorney, Agent, or Firm*—Frishauf, Holtz, Goodman, Langer & Chick, P.C.

[57] ABSTRACT

A method of manufacturing an electrically conductive cermet that includes less than 35% by volume of a precious metal by mixing a powdered refractory ceramic with the powdered metal, molding the mixture into a green, and sintering the green to create a cermet with a dense ceramic phase and a metallic phase in the form of a coherent network. The object is good electric conductivity at a low metal content. The precious metal powder is selected to shrink less and exhibits less sintering tendency as it forms the metallic phase than does the ceramic powder as it forms the ceramic phase.

22 Claims, 6 Drawing Sheets

| BIN | PERIMETER | COUNT | COUNT(%) | BIN | PERIMETER | COUNT | COUNT(%) |
|---|---|---|---|---|---|---|---|
| 1 | 1.00–1.41 | 0 | 0.00 | 11 | 31.6–44.7 | 431 | 10.83 |
| 2 | 1.41–2.00 | 0 | 0.00 | 12 | 44.7–63.1 | 308 | 7.74 |
| 3 | 2.00–2.82 | 0 | 0.00 | 13 | 63.1–89.1 | 231 | 5.81 |
| 4 | 2.82–3.98 | 0 | 0.00 | 14 | 89.1–126 | 120 | 3.02 |
| 5 | 3.98–5.62 | 0 | 0.00 | 15 | 126–178 | 77 | 1.94 |
| 6 | 5.62–7.94 | 249 | 6.26 | 16 | 178–251 | 30 | 0.75 |
| 7 | 7.94–11.2 | 606 | 15.23 | 17 | 251–355 | 10 | 0.25 |
| 8 | 11.2–15.8 | 659 | 16.56 | 18 | 355–501 | 5 | 0.13 |
| 9 | 15.8–22.4 | 658 | 16.54 | 19 | 501–708 | 0 | 0.00 |
| 10 | 22.4–31.6 | 595 | 14.95 | 20 | 708–1000 | 0 | 0.00 |

| BIN | FIELD NUM | AREA% | AREA%(%) |
|---|---|---|---|
| 1 | 1.00–2.00 | 28 | 10.81 |
| 2 | 2.00–3.00 | 28 | 10.81 |
| 3 | 3.00–4.00 | 30 | 11.58 |
| 4 | 4.00–5.00 | 28 | 10.81 |
| 5 | 5.00–6.00 | 30 | 11.58 |

| BIN | FIELD NUM | AREA% | AREA%(%) |
|---|---|---|---|
| 6 | 6.00–7.00 | 28 | 10.81 |
| 7 | 7.00–8.00 | 29 | 11.20 |
| 8 | 8.00–9.00 | 29 | 11.20 |
| 9 | 9.00–10.00 | 29 | 11.20 |

| BIN | DISTANCE | COUNT | COUNT(%) |
|---|---|---|---|
| 1 | 2.00–2.73 | 0 | 0.00 |
| 2 | 2.73–3.72 | 0 | 0.00 |
| 3 | 3.72–5.08 | 0 | 0.00 |
| 4 | 5.08–6.93 | 0 | 0.00 |
| 5 | 6.93–9.46 | 0 | 0.00 |
| 6 | 9.46–12.9 | 0 | 0.00 |
| 7 | 12.9–17.6 | 0 | 0.00 |
| 8 | 17.6–24.0 | 0 | 0.00 |
| 9 | 24.0–32.8 | 410 | 0.48 |
| 10 | 32.8–44.7 | 384 | 0.45 |

| BIN | DISTANCE | COUNT | COUNT(%) |
|---|---|---|---|
| 11 | 44.7–61.0 | 1129 | 1.33 |
| 12 | 61.0–83.3 | 2204 | 2.59 |
| 13 | 83.3–114 | 5032 | 5.92 |
| 14 | 114–155 | 10780 | 12.66 |
| 15 | 155–211 | 12399 | 14.59 |
| 16 | 211–289 | 17218 | 20.26 |
| 17 | 289–394 | 23318 | 27.44 |
| 18 | 394–537 | 11581 | 13.63 |
| 19 | 537–733 | 552 | 0.65 |
| 20 | 733–1000 | 0 | 0.00 |

METHOD OF MANUFACTURING AN ELECTRICALLY CONDUCTIVE CERMET

BACKGROUND OF THE INVENTION

The present invention concerns a method of manufacturing an electrically conductive cermet that includes less than 35% by volume of a precious metal, by mixing a powdered refractory ceramic with the powdered metal, molding the mixture into a green, and sintering the green to create a cermet with a dense ceramic phase and a metallic phase in the form of a coherent network.

Cermets are intimate mixtures of ceramic and metal. They combine the corrosion resistance and hardness of ceramics with the electrical conductivity and strength of metals. They are employed for the terminals of discharge lamps, in sparkplugs, and for sensors in electric mass flowmeters.

Although methods are known for manufacturing an electrically conductive cermet that includes less than 35% by volume of a precious metal, cermets produced by known methods suffer from a loss in conductivity when sintering is accomplished at high temperatures as discussed below.

A generic method of manufacturing a low precious metal volume cermet is known from German 2 658 647 A1. A dispersion of powdered aluminum oxide is treated with chromium nitrate to promote adhesion between the ceramic and the metallic phases. The dispersion is condensed and the resulting particles coated with precious metal, platinum for example, by exposing the particles to a solution of chloroplatinic acid or tetraamine-platinum chloride in the presence of a reducing agent. Platinum is thereby precipitated from the solution onto the individual particles. The result is a skeletal and essentially coherent structure of precious metal enclosing the individual particles. The resulting "green" is sintered at 1400° C. into a cermet with good electric conductivity. The conductivity derives from the coherent metal skeleton. The platinum accounts for approximately 12.5% of by volume of this known cermet.

This known method allows the manufacture of cermets with good electric conductivity. It has, however, been demonstrated that the conductivity of a cermet with such a low percentage of precious metal decreases rapidly subsequent to sintering at higher temperatures required for stronger, gas-tight cermets, above 1500° C. for example. Cermets that are stronger or have a gas-tight structure, however, are needed for some purposes. The manufacture of a strong and dense ceramic phase on the basis of a refractory material, aluminum oxide or zirconium oxide for example, demands sintering temperatures at least that high on the other hand.

Because of the need for high strength, high density cermets, there is ongoing research. It has been demonstrated that the loss of electric conductivity due to sintering at high temperatures can be prevented by using a higher percentage of precious metal, 40% by volume for example. However, the use of more precious metal inevitably increases the cost of the cermet.

BRIEF SUMMARY OF THE INVENTION

It is therefore an object of the present invention to provide a method for the manufacture of cermets based on refractory materials, which combine good electric conductivity and high density, but without a large increase in precious metal content.

This object is attained by an improvement in a method of the aforesaid types which, in accordance with the present invention, uses a precious metal/ceramic powder combination selected so that the precious metal powder shrinks less and exhibits less sintering tendency as it forms the metallic phase than does the ceramic powder as it forms the ceramic phase. The present invention accomplishes this while using less than 35% by volume of the precious metal.

DETAILED DESCRIPTION

Figure 1:
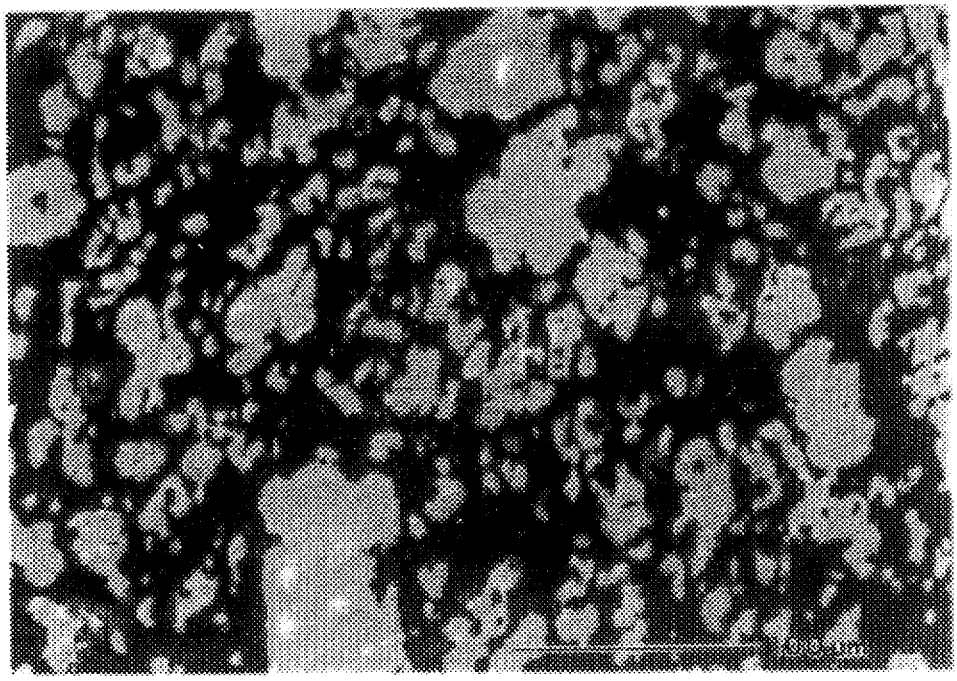
FIG. 1 PRIOR ART
FIG. 1 is representation of a binary scanned or resolved microscopic image of the polished surface of a commercially available cermet.

By selection of the relative sintering properties of the ceramic precursor and the precious metal, high density ceramics which maintain low electrical resistance, can be formed by sintering cermet greens at high temperature. The density of cermets according to the present invention are typically in the range of 8.2 to 9.7 g/cm$^3$.

One possible explanation for the decrease in electric conductivity that occurs when greens with a small content of precious metal are sintered at high temperatures is that the metallic phase shrinks subject to the heat, reducing its specific surface and decreasing the surface energy. This could for example lead to the separation of slender dendrites in the coherent metallic structure and hence to a decrease in the cermet's conductivity. The present invention avoids this problem by making the green out of a precious metal powder with less sintering tendency than the ceramic powder. The transport processes that implement sintering of the metallic phase and lead, by decreasing the phase's radii, to a reduction in its specific surface, will accordingly occur to only a slight extent if at all. The fine metal structures created in the green will, accordingly, remain after the high-temperature sintering step needed to form high density cermets. The fine dendrites in the metallic phase will not be interrupted.

The metal's sintering tendency can be decreased by a number of known measures, specifically for example by adding crystal-growth inhibitors, by limiting the range of the metal powder's particle size, by using particles with a morphology that will decrease surface energy, or by using a powder with a lower specific surface.

It will, on the other hand, be of advantage for the ceramic powder to have a high sintering tendency.

Since the loss in the volume of the metallic phase that accompanies the dense sintering of the green is less than the loss of the volume of the phase forming from the ceramic powder, the relative volume available to the metallic phase in the green, as the green shrinks during sintering, will decrease as sintering proceeds. The ceramic phase shrinks, it can be said, around the structure provided by the metal powder. Even separate regions of precious metal content accommodated in the green will connect. The separation of slender dendrites in the metal-containing regions will be prevented. The electric conductivity of the dense-sintered cermet will accordingly be higher than that of the green. The effect is even more marked the more the volumetric loss of the metallic phase differs from that of the metallic phase. One way to ensure that this difference in loss will be as great as possible during the sintering is to use a metal with a very small volumetric loss and/or a ceramic with a very large volumetric loss.

The volumetric loss of the powder employed to produce the green is measured with a dilatometer. Samples are cold-pressed from the metal and ceramic powders. Increases in the volume of the precious metal powder when heated have also been observed in some circumstances. Volumetric increases can be explained for example by relaxation processes in the prefabricated samples. The "small" volumetric loss required when practicing the present invention, as noted above, as accompanying the sintering of the precious metal powder can accordingly also mean a negative loss i.e. an increase in volume.

The sintering tendency of the precious metal powder must be lower than that of the ceramic powder. The actions of the two powders can be compared by heating cold-pressed samples of each and observing the growth of the grain. The powder that begins to show grain growth at a lower temperature has the higher sintering tendency.

Particularly satisfactory results occur when the precious metal powder has a specific surface of less than 1 $m^2/g$ and preferably less than 0.1 $m^2/g$ as measured by the Brunauer-Emmett-Teller (BET) method. The sintering tendency of such a powder is, due to the low surface energy, particularly low. Structures and networks in the green produced with such a powder will accordingly be preserved even when it is sintered at a high temperature of over 1500° C., thereby maintaining low electrical resistance.

It has also been demonstrated to be practical when 50% by weight of the precious metal powder has a particle size of less than 20 μm and preferably less than 15 μm and 10% by weight has a particle size of at least 2 μm and preferably 4 μm. Such a powder will have a relatively limited range of particle size and a mean particle size that will be appropriate for slow sintering. Very small particles are to be avoided as much as possible because their shorter radii result in a higher surface energy and hence sintering tendency. Very large starting particles next to smaller particles can experience the more powerful grain growth called giantism, with the areas around the "gigantic" grains impoverished in metal. This impoverishment can lead to breakage in the filigreed metallic network structure. A limited range of particle sizes will also decrease the sintering rate.

A method wherein the ceramic powder has a specific surface at least 20 times larger than that of the precious metal powder as measured by the BET method is preferred. Specific surface is a measure of sintering tendency. A ceramic with a larger specific surface than that of the metal can be expected to have a higher sintering tendency. This ensures early volumetric loss in the ceramic phase early in the sintering process.

It has also been demonstrated of advantage for the ceramic powder to have a mean particle size at least 10 times smaller than that of the precious metal powder, whereby at least 90% by weight of the ceramic powder has a particle size no larger than 5 μm.

Of particular advantage is a precious metal powder that will lose at least 5% less and preferably 10% less volume entering the metal phase as the green is sintered than the ceramic phase will lose. Since only the difference in specific-volumetric shrinkage is important, the type of starting materials employed can depend on the properties of the ceramic instead of on the metal. As heretofore mentioned, the volumetric shrinkage observed in the metal can be zero or even negative (i.e. increase in volume) in certain situations.

A ceramic powder with a volumetric loss that begins at a lower temperature than that of the metal powder can be employed. This feature will ensure that the metallic phase never has access during dense sintering to a relative volume inside the green that is larger than its relative starting volume. This prevents rips in the fine dendrites in the metallic phase.

Cermet ceramic precursor powders can include not only $Al_2O_3$ but also e.g. powders of MgO, $ZrO_2$ or oxides of rare earth metals. Production of required powders is generally known in the art. The production of the $Al_2O_3$ ceramic precursor powder for example is described in DE-C2 40 29 066. According to column 2, line 60 ff and column 4, line 4 ff of DE-C2 40 29 066, alum earth as commercially available having admixtures of $ZrO_2$ and $Y_2O_3$, is pulverized by using $ZrO_2$-grinding bodies until a medium fineness of 1 μm is achieved. The finished pulverized product may contain 6 Vol.-% of $ZrO_2$ (partly resulting from the abrasion of $ZrO_2$ grinding bodies) and 0.85 weight-% $Y_2O_3$. We have measured the apparent density (density after pouring into a vessel without compression) of such a powder and found a quite high value of 800 to 900 g/l (0.80 to 0.90 $g/cm^3$). The theoretical density of $Al_2O_3$ is about 4 $g/cm^3$.

Although the principle of operation of the invention can be broadly applied, as a practical matter only platinum and materials based on platinum are normally used. Practical considerations include cost, the high sintering temperature of between 1500° C. and 1750° C., electrical conductivity and the possibility that the sintering will take place in an oxidizing (air) atmosphere. Thus, the "precious metal powder" of the present invention normally means platinum or platinum based alloys. The alloys will normally contain at least 50% platinum in combination with one or more of Iridium (Ir), Ruthenium (Ru), Rhodium (Rh) and Palladium. However, the precious metal powder can also be Ir, Ru, Rh or Pd or an alloy similar to the Pt alloy but based on at least 50% of these metals, with one or more of the others or of Pt.

The precious metal powder can be prepared from commercially available Pt-powder or other metal powder having a median grain size of about 20 μm. This powder is subjected to a thermal preparatory treatment at a temperature in the range between 700° C. and 850° C. for about 1 hour. After the thermal treatment, the resulting powder has a very low sinter activity. For the elimination of very large grains of the powder it is sieved through a mesh and a sieve fraction having a specific surface of less than 0.1 $m^2/g$ (BET method) is recovered.

The resulting powder has an apparent density of about 3.0 $g/cm^3$ (for Pt) and a settled apparent density (or tap density measured after tapping the vessel holding the powder with its bottom-side to a plate, about 1000 times) of about 3.9 $g/cm^3$ which is quite low (the density of platinum is about 21 $g/cm^3$).

It is also possible to prepare the ceramic powder having a high sinter activity and a high volume shrinkage or the precious metal powder having a low sinter activity and a low volume shrinkage by other methods; for example a suitable chemical pretreatment of the powders.

A method wherein the precious metal powder is platinum, the refractory ceramic contains aluminum oxide, and sintering occurs at temperatures between 1500° and 1750° C. and preferably just below the melting point of platinum has been demonstrated particularly effective. The result is a particularly dense cermet. It has been demonstrated that dense-sintered cermets with a very high electric conductivity can be manufactured with even as little as 25% by volume of platinum. The preferred sintering temperatures are around 1700° C.

An embodiment of the present invention will now be described with reference to the drawings.

Figure 2:
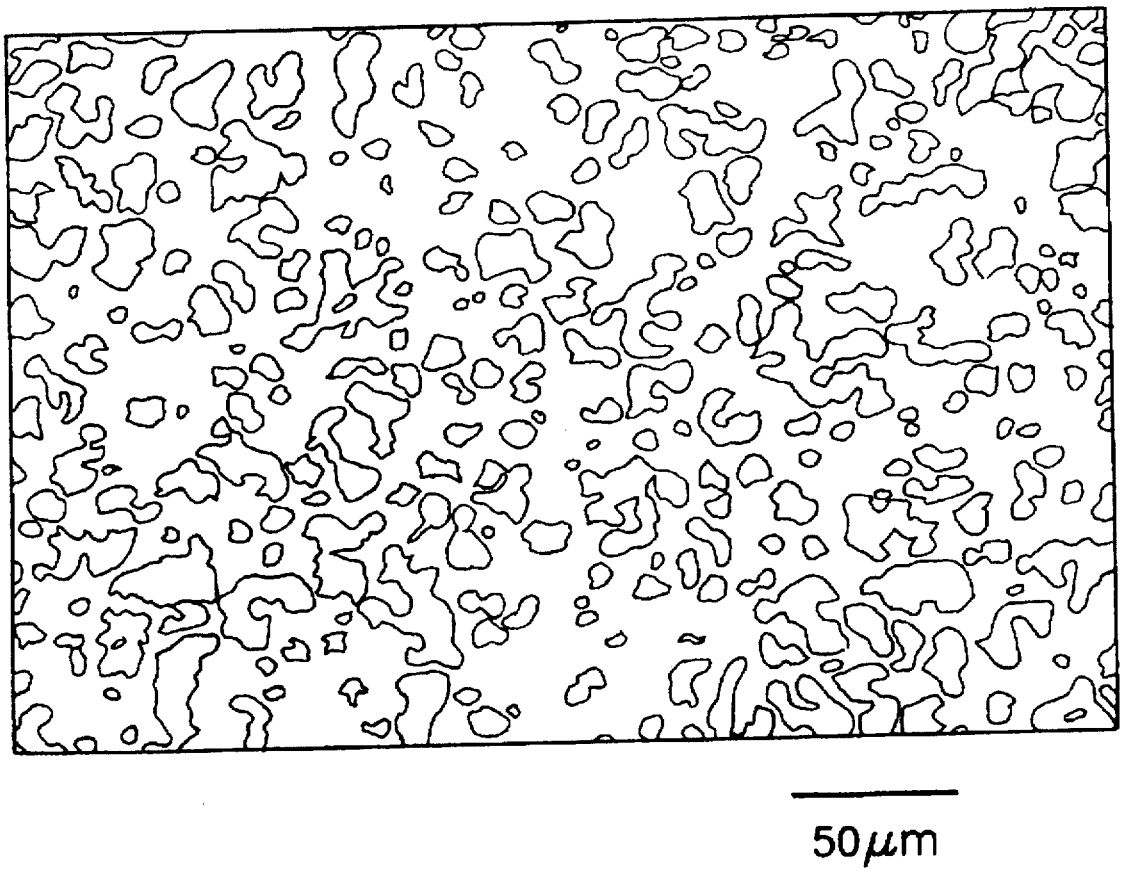
FIG. 2 is representation of a binary scanned or resolved microscopic image of the polished surface of a cermet produced in accordance with the present invention.

The ceramic phase is represented as black and the metallic as white in FIG. 1. In FIG. 2 the ceramic phase is shown by irregular closed domains and the metallic phase is shown by the ground. The ceramic phase is aluminum oxide and the metallic phase platinum in both illustrations.

The state-of-the-art cermet illustrated in FIG. 1 includes approximately 40% by volume of platinum. Its ceramic phase is essentially aluminum oxide ($Al_2O_3$) and is sintered to a dense cermet. This cermet must accordingly have been sintered at more than 1650° C.

Immediately apparent in the image is the wide variation in size of the areas of metal. Some very large ones in fact are visible. These large coherent areas of metallic phase have very many pores. It will also be evident that the separate areas of the metallic phase have many sharp edges or very short radii. A powder with a very powerful sintering tendency was obviously employed to produce this cermet. The powerful sintering tendency might also for example have caused the concentration of the metallic phase in the aforesaid very large areas. These areas essentially do not contribute to the cermet's electric conductivity. On the contrary, they are detrimental to it at any level of platinum because the conductivity is concentrated within them and accordingly absent almost everywhere else. The irregular distribution of the metallic phase apparent in FIG. 1 also induces tension in the cermet due to the different coefficients of expansion of the ceramic and metal and accordingly weakens the material.

The cermet according to the present invention, illustrated in FIG. 2 on the other hand is 30% platinum by volume, the remainder consisting essentially of aluminum oxide. The green was mixed and molded from the starting powders and sintered at 1700° C.

In comparison to the one illustrated in FIG. 1, the surface illustrated in FIG. 2 is striking for the more uniform distribution of the metallic phase throughout the ceramic phase. It has been demonstrated helpful in order to ensure high electric conductivity for the polished areas of the metallic phase to have, as illustrated in FIG. 2, an area of no more than 1000 and preferably less than 800 $\mu m^2$ and for the curve representing the distribution of areas to slope down very steeply from its maximum. Such a limited range in the size of areas of metal in the image indicates homogeneous distribution and a slender-dendritic structure.

Comparison of the two figures will also reveal that the areas of metallic phase in the cermet in FIG. 2 are slightly rounder on the whole and are in particular distinguished by rounded edges. This feature is an indication of a weaker sintering tendency on the part of the starting powder. Only a few pores are evident.

Figure 3:
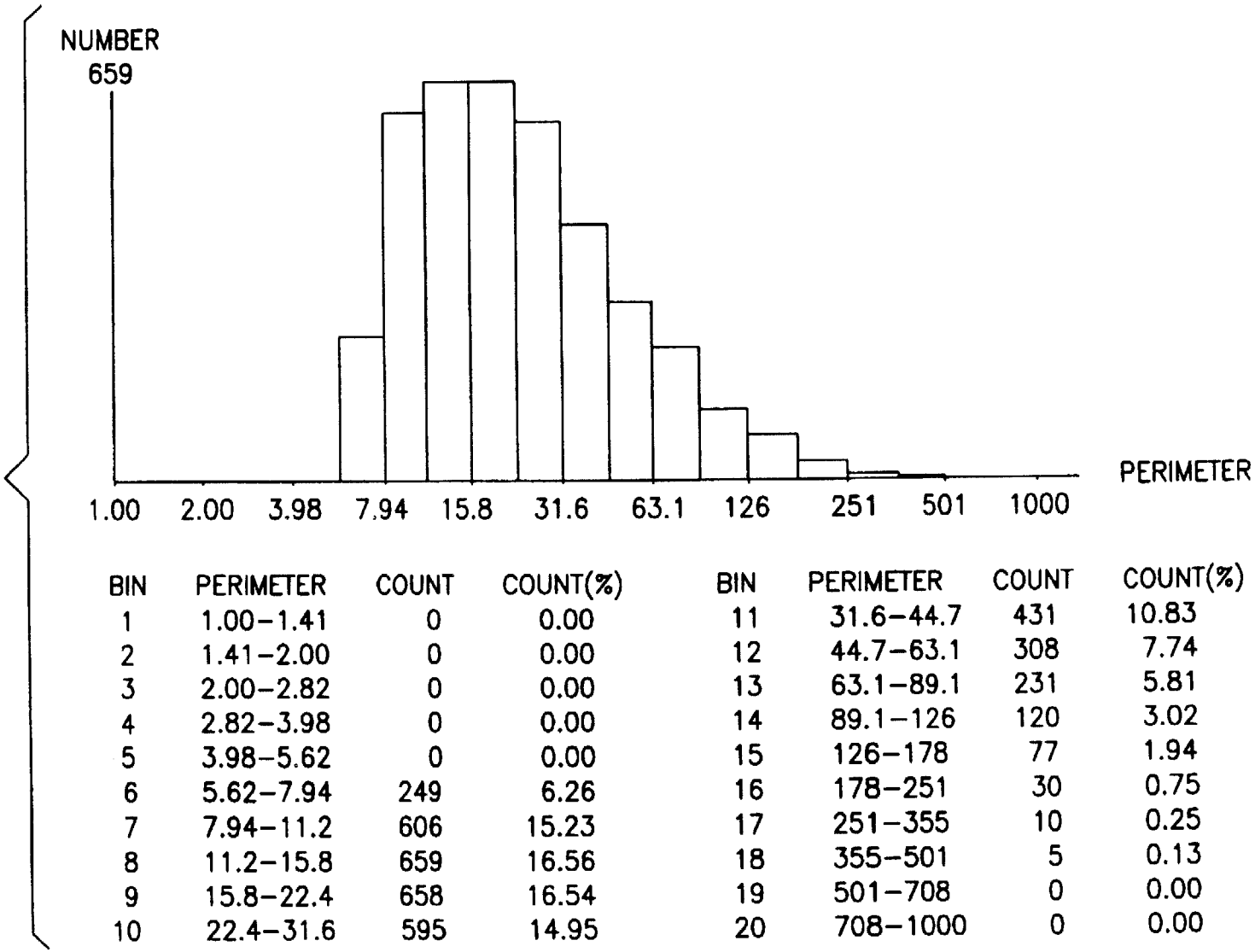
FIG. 3 is a statistical interpretation of the surface illustrated in FIG. 2.
Figure 4:
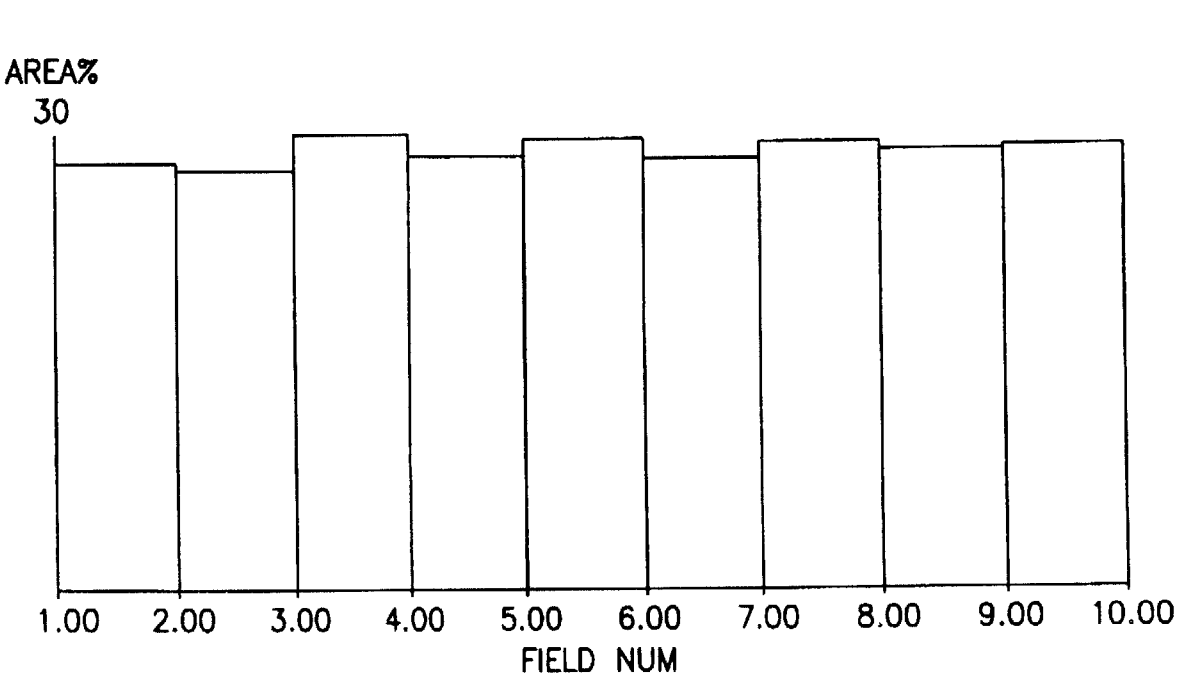
FIG. 4 is another statistical interpretation of the surface illustrated in FIG. 2.
Figure 5:
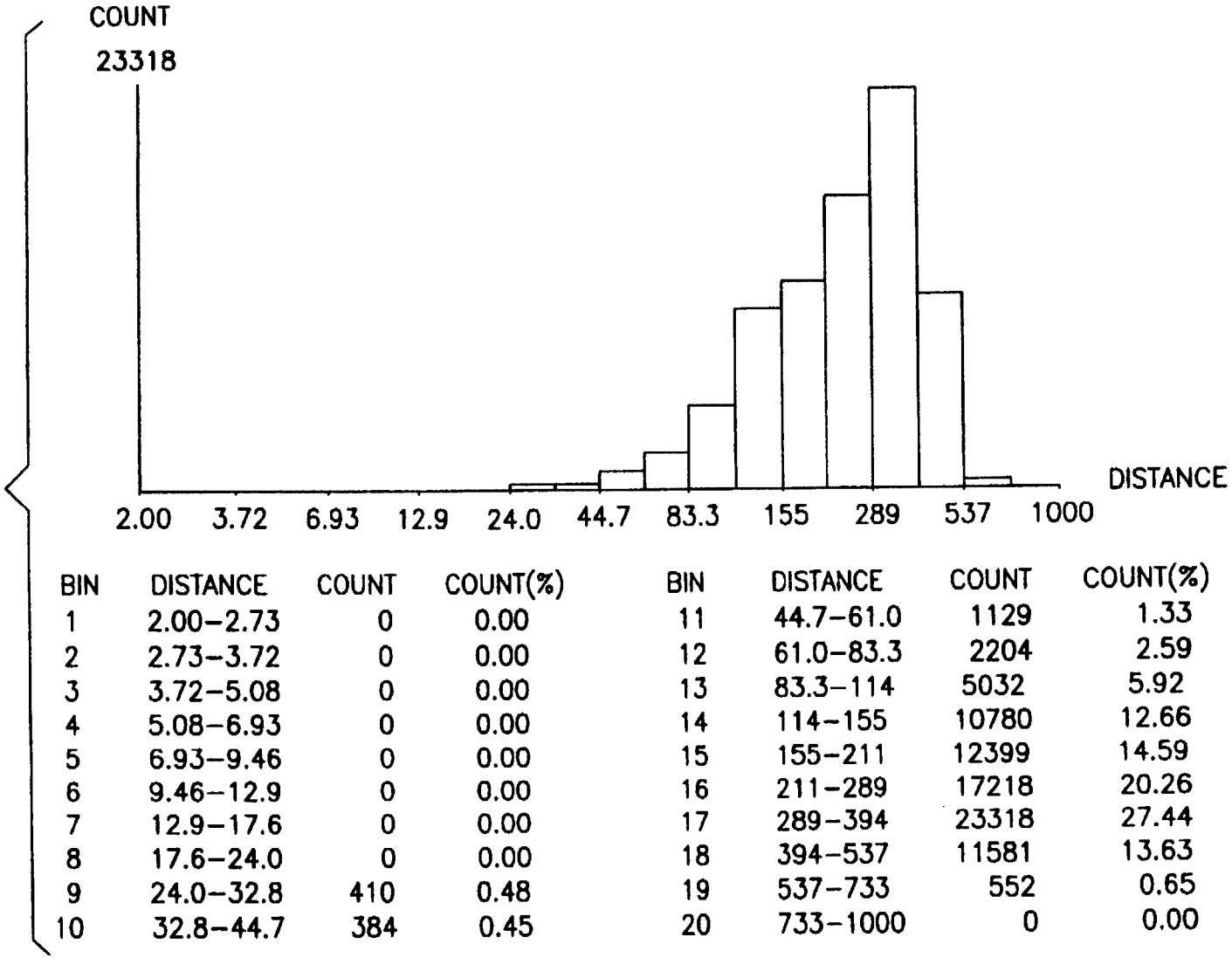
FIG. 5 is still another statistical interpretation of the surface illustrated in FIG. 2.

The foregoing remarks will be supported by the statistical analyses illustrated in FIGS. 3 through 5.

FIG. 3 is a histogram illustrating the results of a statistical image analysis of the distribution of metallic phase throughout the polished surface illustrated in FIG. 2. The horizontal axis of the graph represents the length in μm broken down into classes of the line demarcating the border of an area of metallic phase. The vertical axis represents the absolute frequency of each class of length. The maximal frequency occurs for a perimeter approximately 16 μm long. The frequency decreases rapidly in the direction of shorter lengths and somewhat more slowly toward the longer lengths. The range of frequencies is on the other hand relatively narrow on the whole. The mean is 32 μm. The frequencies for each range are listed individually below the graph.

FIG. 4 is another histogram representing the area of the metallic phase in a total of 9 statistically selected surfaces. This graph impressively demonstrates that the area covered by the metallic phase in each surface is almost a constant 29%. This feature is another indication of the uniform distribution of the metal phase.

The analysis illustrated in FIG. 5 represents another frequency distribution in the form of a histogram. The horizontal axis represents the distance between adjacent areas of metallic phase in μm and the vertical axis the absolute frequency of each class of distances. The maximal frequency per class ranges from 289 to 394 μm. The mean distance is 260 μm. This distribution slopes rapidly toward the longer distances and is not quite as steep as it approaches the shorter distance. The overall distribution, however, is very narrow.

The analyses represented in FIGS. 3 through 5 document the uniform distribution of the metallic phase in the cermet in accordance with the present invention.

Figure 6:
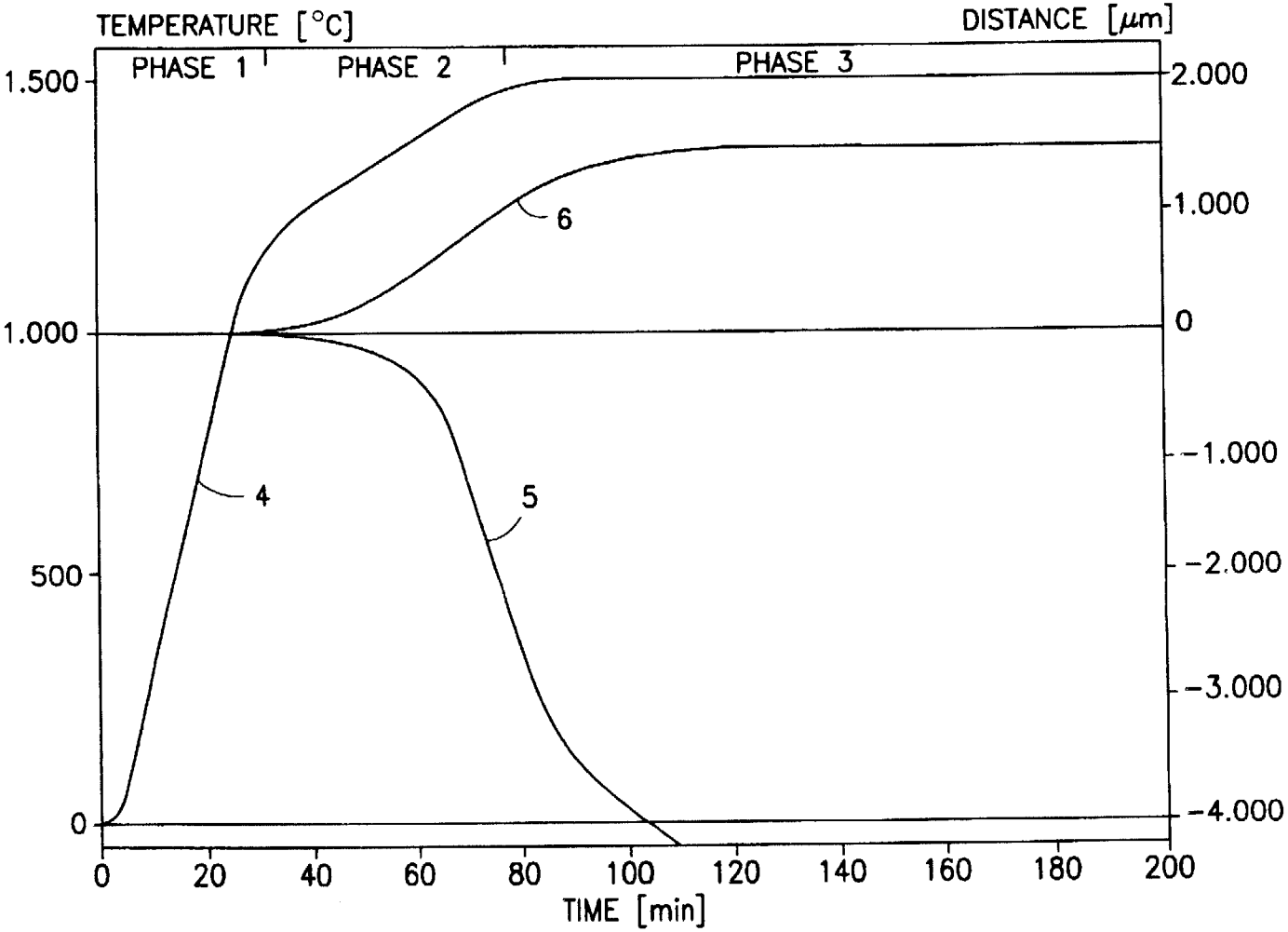
FIG. 6 is a graph of the results of dilatometric measurement of a ceramic powder employed to manufacture the cermet in accordance with the present invention and of a precious metal powder.

FIG. 6 represents the results of dilatometric measurements of an aluminum-oxide powder and platinum powder employed to produce a cermet in accordance with the present invention. The measurements were obtained from cold pressings. The aluminum-oxide pressings were 39.31 mm long and the platinum pressings 23.48 mm long.

The horizontal axis of the graph in FIG. 6 represents time in minutes, the left-hand vertical axis temperature in °C., and the right-hand vertical axis the measured changes in the length of the pressings. The "Phase 1" in the diagram is the initial and rapid heating phase, the "Phase 2" a directly subsequent and slower heating phase, and the "Phase 3" a region of constant high temperature, approximately 1600° C. The associated temperatures are indicated by curve 4. The measured expansion of the aluminum-oxide pressing is represented by curve 5 and that of the platinum pressing by curve 6.

It will be evident from the curves that the aluminum-oxide pressing begins to lose volume at approximately 1400° C. As the temperature increases, the length of the pressing decreases rapidly, which suggests rapid sintering. The total irreversible longitudinal shrinkage of the aluminum-oxide pressing is 13.8%.

Curve 5, which plots the expansion of the platinum pressing, reveals no decrease in length as temperature increases. On the contrary, sintering at the high temperature of 1580° C. is even accompanied by an irreversible increase in length of approximately 6%. It will accordingly be evident that even at maximal-temperature dilatometer measurements there has been no sintering of the platinum powder. If it had, the length of the sample would have decreased.

The results of the dilatometric measurements represented in FIG. 6 reveal that the platinum powder employed to produce the cermet has less sintering tendency than the aluminum-oxide powder, and that no decrease in volume can accordingly be observed at sintering temperatures of 1600° C. The aluminum-oxide powder employed in the cermet on the other hand exhibits a very definite volumetric shrinkage at this temperature. Consequently, the ceramic aluminum-oxide phase of even a homogeneous mixture of the two powders will sinter more rapidly and shrink so to speak over the three-dimensional platinum skeleton available in the green, stabilizing it and rendering the cermet conductive.

A starting powder for producing a cermet in accordance with the present invention will now be described.

The platinum powder employed to prepare a green containing 25% by volume of platinum with the remainder being aluminum oxide had a BET surface of 0.06 $m^2/g$. Its mean particle size was 10 μm. Approximately 80% by weight of the powder consisted of particles ranging in size from 4 to 20 μm. Such a powder is distinguished on the whole by a very low sintering tendency. The structure characteristic of the green is accordingly essentially retained even during sintering at 1700° C.

The starting aluminum-oxide ($Al_2O_3$) powder exhibited an average particle size of approximately 1 μm, and 90% by weight had a particle size of less than 3 μm. Its BET surface was 4 $m^2/g$. Such an aluminum-oxide ($Al_2O_3$) powder is distinguished by a sintering tendency that is definitely higher than that of the platinum powder. It has also been demonstrated that the ceramic phase that derives from the aluminum-oxide powder during dense sintering loses essentially more volume than the metallic phase deriving from the platinum powder. A definite decrease in volume occurs in the ceramic phase at a temperature of approximately 1400° C., whereas no change in volume is evident in the metallic phase. This difference in the changes of volume between the two starting powders also contributes to stabilization of the structure represented in the green by the metallic phase as well as by the shrinkage of the ceramic phase against the metallic phase. The result is a reticulated and essentially slender-dendritic structure of coherent platinum-containing regions that leads to high electric conductivity in the dense-sintered cermet.

The electric impedance in a 6-mm thick disk of cermet manufactured in accordance with the present invention with a platinum content of 25 to 30% by volume and a diameter of approximately 10 mm was less than 10 Ω.

The above is illustrative but not limitative of the invention as various modifications within the scope of the invention would be obvious to persons skilled in the art. Thus, for example, the invention can be practiced with larger amounts of precious metals or different precious metals/ceramic combinations. The important feature is the differential sintering which characterizes the components used to make the cermet.

What is claimed is:

1. A method of manufacturing an electrically conductive cermet having less than 35% by volume of a precious metal comprising the steps of mixing a powdered refractory ceramic with powdered precious metal, the precious metal powder and the ceramic powder being selected such that during sintering, the precious metal powder shrinks less and exhibits less sintering tendency as it creates the metallic phase than the ceramic powder does as it creates the ceramic phase;

molding the mixture into a green; and sintering the green to form a cermet with a dense ceramic phase and a metallic phase in the form of a coherent network wherein the precious metal powder is platinum or an alloy containing at least 50% platinum and the remainder at least one metal selected from the group consisting of Ir, Ru, Rh or Pd, and is selected to have a mean particle size of at least 10 μm and no more than 10% by weight has a particle size of less than 2 μm;

the refractory ceramic contains $Al_2O_3$, MgO, $ZrO_2$ or oxides of rare earth metals; and sintering occurs at temperatures between 1500° C. and 1750° C.

2. The method as claimed in claim 1, wherein the precious metal powder has a specific surface of less than 1 $m^2/g$ as measured by the BET method.

3. The method as claimed in claim 2 wherein the precious metal powder has a specific surface of less than 0.1 $m^2/g$ as measured by the BET method.

4. The method as claimed in claim 1, wherein the particle size is at least 20 μm.

5. A method of manufacturing an electrically conductive cermet having less than 35% by volume of a precious metal comprising the steps of mixing a powdered refractory ceramic with powdered precious metal, the precious metal powder and the ceramic powder being selected such that during sintering, the precious metal powder shrinks less and exhibits less sintering tendency as it creates the metallic phase than the ceramic powder does as it creates the ceramic phase;

molding the mixture into a green; and sintering the green to form a cermet with a dense ceramic phase and a metallic phase in the form of a coherent network;

wherein the precious metal powder is selected to have a mean particle size of at least 10 μm and no more than 10% by weight has a particle size of less than 2 μm; and the ceramic powder is selected to have a specific surface at least 20 times larger than that of the precious metal powder as measured by the BET method.

6. The method as claimed in claim 5, wherein the ceramic powder is selected to have a mean particle size at least 10 times smaller than that of the precious metal powder, whereby at least 90% by weight of the ceramic powder has a particle size no larger than 5 μm.

7. The method as claimed in claim 6, wherein the precious metal powder and ceramic powder are selected such that the precious metal powder loses at least 5% less volume entering the metal phase as the green is sintered than the volume lost by the ceramic phase.

8. The method as claimed in claim 6, wherein the ceramic powder and metal powder are selected so that the ceramic powder has a volumetric loss during sintering that begins at a lower temperature than the temperature at which the metal powder has a volumetric loss during sintering.

9. The method as claimed in claim 8, wherein the precious metal powder is platinum, the refractory ceramic contains aluminum oxide.

10. The method as claimed in claim 9, wherein the sintering occurs at a temperature just below the melting point of platinum.

11. The method as claimed in claim 9, wherein the precious metal powder and ceramic powder are selected such that the precious metal powder loses at least 10% less volume entering the metal phase as the green is sintered than the ceramic phase loses.

12. The method as claimed in claim 11 wherein the precious metal powder has a specific surface of less than 0.1 $m^2/g$ as measured by the BET method.

13. A method of manufacturing an electrically conductive cermet having less than 35% by volume of a precious metal comprising the steps of mixing a powdered refractory ceramic with powdered precious metal, the precious metal powder and the ceramic powder being selected such that during sintering, the precious metal powder shrinks less and exhibits less sintering tendency as it creates the metallic phase than the ceramic powder does as it creates the ceramic phase;

molding the mixture into a green; and sintering the green to form a cermet with a dense ceramic phase and a metallic phase in the form of a coherent network;

wherein the precious metal powder is platinum or an alloy containing at least 50% platinum and the remainder at least one metal selected from the group consisting of Ir, Ru, Rh or Pd, the refractory ceramic contains $Al_2O_3$, MgO, $ZrO_2$ or oxides of rare earth metals and sintering occurs at temperatures between 1500° C. and 1750° C.; and the precious metal powder and ceramic powder are selected such that the precious metal powder loses at least 5% less volume entering the metal phase as the green is sintered than the volume lost by the ceramic phase.

14. The method as claimed in claim 13, wherein the ceramic powder and metal powder are selected so that the ceramic powder has a volumetric loss during sintering that begins at a lower temperature than the temperature at which the metal powder has a volumetric loss during sintering.

15. A method of manufacturing an electrically conductive cermet having less than 35% by volume of a precious metal comprising the steps of mixing a powdered refractory ceramic with powdered precious metal, the precious metal powder and the ceramic powder being selected such that during sintering, the precious metal powder shrinks less and exhibits less sintering tendency as it creates the metallic phase than the ceramic powder does as it creates the ceramic phase;

molding the mixture into a green; and sintering the green to form a cermet with a dense ceramic phase and a metallic phase in the form of a coherent network;

wherein the precious metal powder is Ir, Ru, Rh or Pd, or an alloy containing at least 50% Ir, Ru Rh or Pd and the remainder being Ir, Ru, Rh, Pd or Pt or a mixture thereof.

16. In an electrically conductive cermet of the type formed by sintering a refractory ceramic green wherein a precious metal is dispersed to provide the electric path, wherein the improvement comprises said cermet containing approximately 25% to 35% precious metal;

said cermet having been sintered at temperatures of 1500° to 1750° C. to obtain a high density ceramic; and a 6 mm thick disk of said cermet, 10 mm in diameter, has an electric resistance of less than 10Ω.

17. The cermet of claim 16 having a density of 8.2 to 9.7 $g/cm^2$.

18. The cermet as claimed in claim 16, wherein the precious metal is platinum or an alloy containing at least 50% platinum and the remainder at least one metal selected from the group consisting of Ir, Ru, Rh or Pd, and the refractory ceramic green contains a ceramic powder which is $Al_2O_3$, MgO, $ZrO_2$ or oxides of rare earth metals.

19. The cermet as claimed in claim 18, wherein the refractory ceramic green contains the precious metal in powder form and the precious metal powder and the ceramic powder are selected such that the precious metal powder loses at least 5% less volume entering the metal phase as the green is sintered than the volume lost by the ceramic phase.

20. The cermet as claimed in claim 19, wherein the ceramic powder and metal powder are selected so that the ceramic powder has a volumetric loss during sintering that begins at a lower temperature than the temperature at which the metal powder has a volumetric loss during sintering.

21. The cermet of claim 19 having a density of 8.2 to 9.7 $g/cm^2$.

22. The cermet as claimed in claim 16 wherein the precious metal is Ir, Ru, Rh or Pd, or an alloy containing at least 50% Ir, Ru Rh or Pd and the remainder is Ir, Ru, Rh, Pd or Pt or a mixture thereof.

* * * * *